US005752288A

United States Patent [19]

Parkin et al.

[11] Patent Number: 5,752,288

[45] Date of Patent: May 19, 1998

[54] SOOT BLOWER ASSEMBLY

[75] Inventors: Gregory A. Parkin, Erie; Ronald M. Gray, Edinboro, both of Pa.

[73] Assignee: Copes-Vulcan, Inc., Lake City, Pa.

[21] Appl. No.: 761,239

[22] Filed: Dec. 6, 1996

[51] Int. Cl.[6] ..... F23J 3/02

[52] U.S. Cl. ..... 15/316.1; 15/318; 122/390

[58] Field of Search ..... 15/316.1, 318, 15/317; 165/95; 122/379, 390, 392

[56] References Cited

U.S. PATENT DOCUMENTS

| | | | |
|---|---|---|---|
| 3,230,658 | 1/1966 | Saltz | 15/317 |
| 4,222,144 | 9/1980 | Horner et al. | 15/317 |
| 4,803,959 | 2/1989 | Sherrick et al. | 122/379 |
| 5,097,564 | 3/1992 | Billings | 15/316.1 |

*Primary Examiner*—Chris K. Moore

*Attorney, Agent, or Firm*—Pearne, Gordon, McCoy & Granger LLP

[57] ABSTRACT

A soot blower lance tube indexing mechanism including a pinion, first and second pinion ratchet/sprocket assemblies, a spindle, first and second spindle sprockets, and a clutch. The clutch is operable to link the first pinion ratchet/sprocket assembly with the first spindle sprocket to rotatably drive the spindle in a first direction when the lance tube is extended. The clutch is further operable to link the second ratchet/sprocket assembly with the second spindle sprocket to rotatably drive the spindle when the lance tube is retracted. In an alternative embodiment, the lance tube rotates in a single direction regardless of whether the lance tube is being extended or retracted.

3 Claims, 9 Drawing Sheets

SOOT BLOWER ASSEMBLY

BACKGROUND OF THE INVENTION

1. Field of the Invention

The present invention is generally directed toward soot blowers and, more particularly, toward soot blower lance indexing mechanisms.

2. Description of Related Art

Soot blowers include a lance which is rotatably driven while the lance is extended into and retracted from a boiler. As the lance traverses and rotates, a blowing or cleaning medium is expelled from a lance nozzle to clean soot from the interior of the boiler and the heating tubes therein.

It has been realized that it is desirable to change the spray pattern of the cleaning medium to prevent the sprayed cleaning medium from impinging upon the same surfaces during each insertion/retraction cycle. Unfortunately, the various attempts to alter the spray pattern have been less than ideal, and have complicated the manufacture and assembly of soot blowers. Therefore, there exists a need in the art for an improved soot blower lance indexing mechanism.

SUMMARY OF THE INVENTION

The present invention is directed toward an improved soot blower assembly wherein a reliable and easily manufactured lance indexing mechanism is employed.

In accordance with the present invention, the soot blower includes a lance, a spindle secured to the lance for common rotation therewith, and a traveling carriage. The traveling carriage is operable to impart translational and rotational motion on said lance. The traveling carriage includes an indexing mechanism.

In further accordance with the present invention, the indexing mechanism includes first and second spindle sprockets, a pinion including a first pinion sprocket and a second pinion sprocket, means to rotatably link the first spindle sprocket to the first pinion sprocket and means to rotatably link the second spindle sprocket to the second pinion sprocket.

In further accordance with the present invention, the indexing mechanism includes a clutch that is operable to link the pinion to one of the first and second pinion sprockets for common rotation dependent upon a direction of pinion rotation. Rotation of the pinion in a first direction is communicated to the lance via the first pinion sprocket and the first spindle sprocket and rotation of the pinion in a second, opposite direction is communicated to said lance via the second pinion sprocket and the second spindle sprocket.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1A:
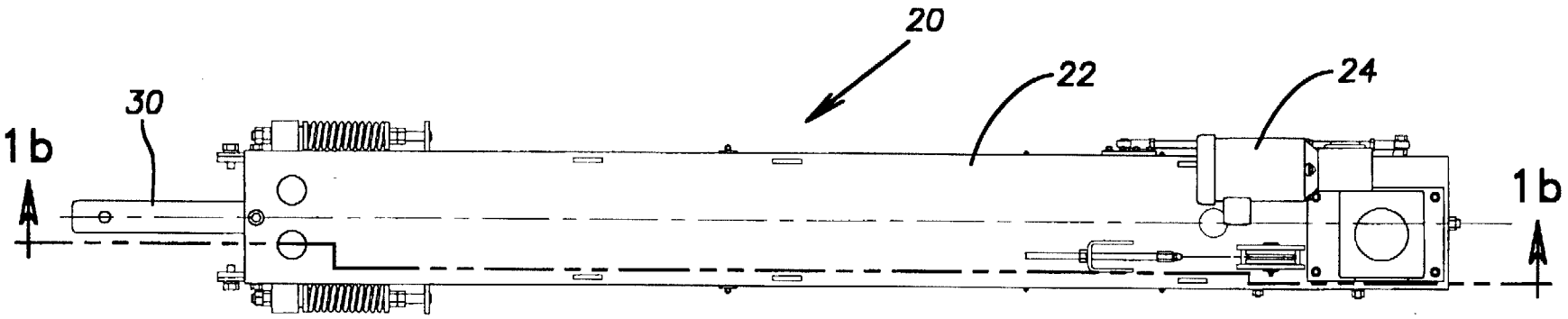
FIG. 1*a* is a top plan view of a soot blower according to the present invention.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

Figure 1B:
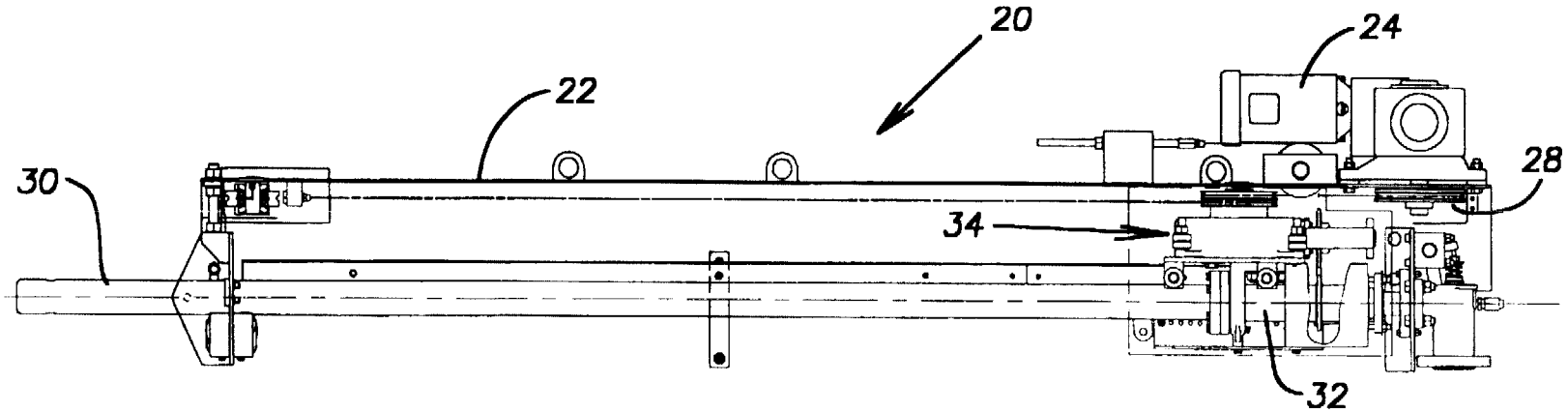
FIG. 1*b* is a cross-sectional view of the soot blower as seen along line A—A in FIG. 1*a;*
Figure 1C:
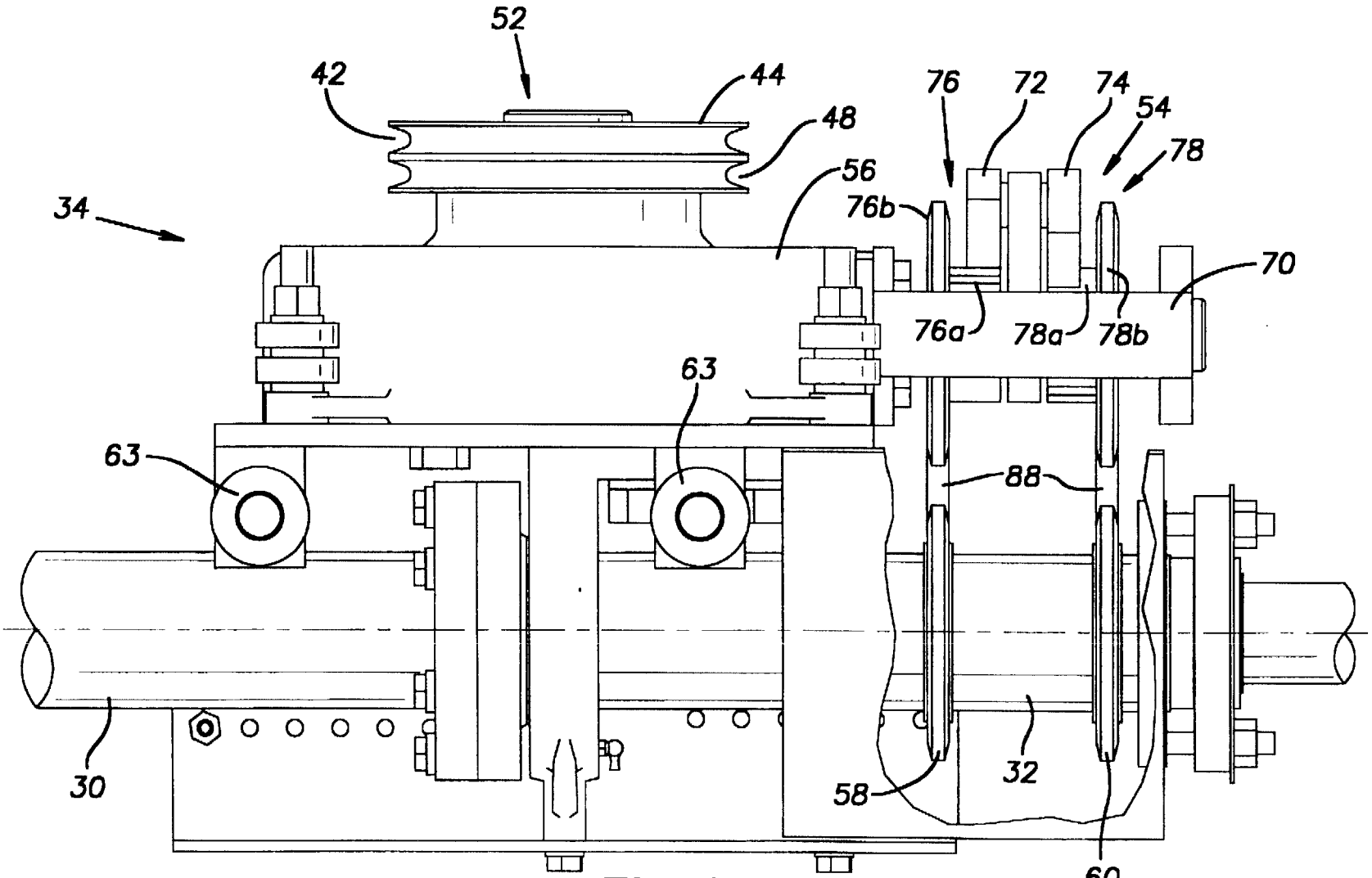
FIG. 1*c* is an enlarged elevational view of the spindle housing assembly, comprising the spindle, lance tube, and lance indexing mechanism according to the present invention.

With reference to FIGS. 1*a*–1*c*, a soot blower 20 according to the present invention is illustrated. The soot blower generally includes a housing 22, a drive motor 24 secured to a top of the housing, a lance 30, a spindle 32, a traveling carriage assembly 34, and a cable drive system 26 including a drive wheel 28.

Figure 2A:
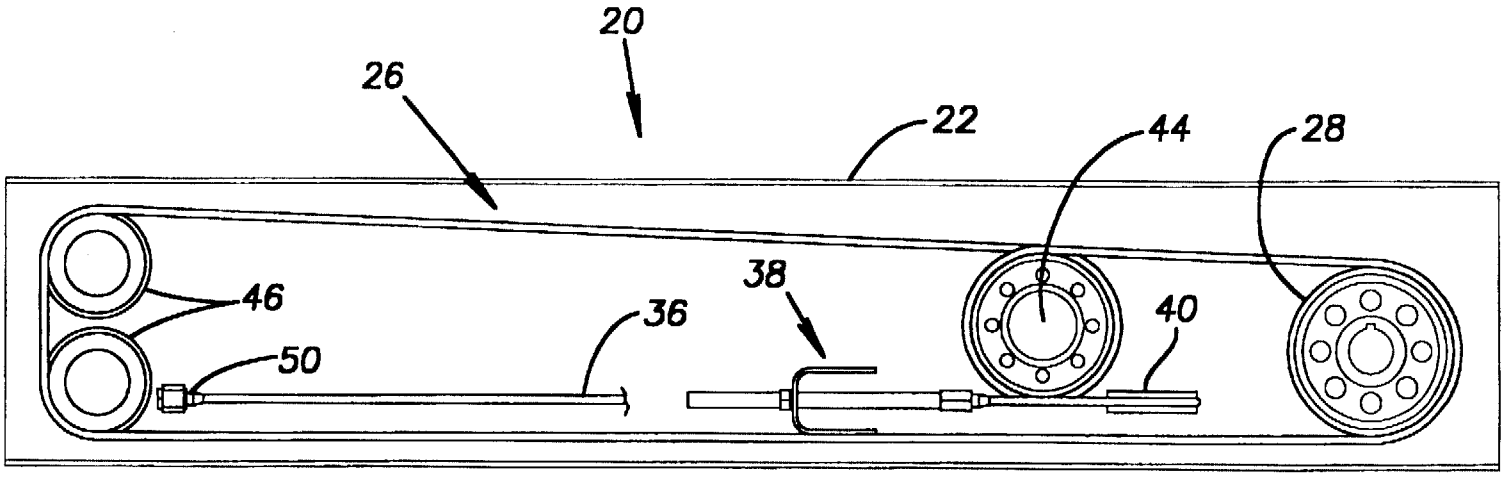
FIG. 2 is a schematically illustrates a cable drive system used in conjunction with the present invention.
Figure 2B:
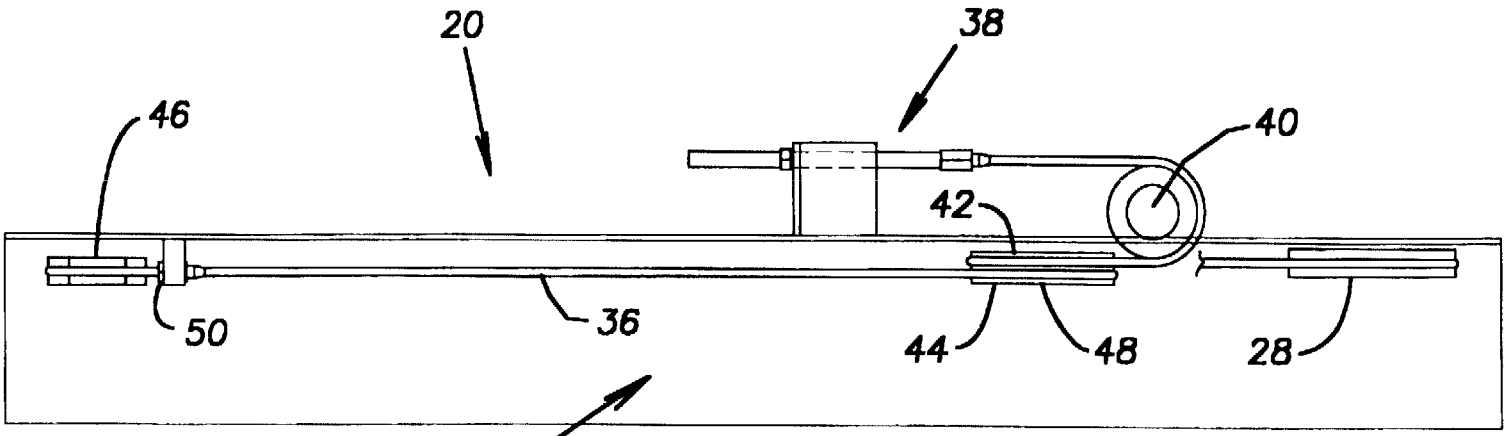

The drive wheel 28 has a drive cable 36 wrapped tightly therearound. The cable drive system 26 is schematically illustrated in FIG. 2. The drive cable 36 extends rearwardly from a rearward cable tensioner 38 and around a horizontal-axis idler pulley 40, then forwardly and around a top groove 42 (FIG. 1*c*) of a sheave wheel pulley 44. From the sheave wheel pulley 44 the cable extends rearwardly and around the drive wheel 28, then forwardly and around a front cable spring tensioner/idler assembly 46, and then rearwardly and around a bottom groove 48 (FIG. 1*c*) of the sheave wheel pulley 44. From the sheave wheel pulley 44, the cable 36 extends forwardly to a front cable mount 50 which is attached to the housing. The front and rear cable tensioners 46, 38 are adjustable to tension the drive cable 36 to permit frictional transmission of movement between the drive cable 36, drive wheel 28, and sheave wheel pulley 44.

The drive motor 24 is operable to rotate the drive wheel 28 which, in turn, via the drive cable 36, rotates the sheave wheel pulley 44. Rotation of the sheave wheel pulley provides both rotation and translation to the traveling carriage 34 and the lance tube 30.

The traveling carriage 34 includes a spindle assembly 52 and an indexing mechanism 54. The spindle assembly 52 includes the spindle 32 and a housing 56 to which the spindle 32 is mounted. The spindle includes a flanged end to which the lance tube 30 is bolted, and first and second spindle sprockets 58, 60. The housing 56 encloses a bevel gear 62. The bevel gear 62 is keyed, at a hub portion, to the sheave wheel pulley 44 and, therefore, rotation of the sheave wheel pulley 44 by the drive cable 36 rotates the bevel gear 62. A series of rollers 63 are attached to the housing 56 and are received within tracks mounted on opposite sidewalls of the soot blower housing 22.

The indexing mechanism 54 includes a pinion 64 that meshes with the bevel gear 62. The pinion 62, which includes a shaft 66, extends though an opening 68 in the housing 56. The pinion shaft 66 is rotatably supported by a framework 70. The framework 70 is secured to the exterior of the housing 56 adjacent the housing opening 68.

Figure 3:
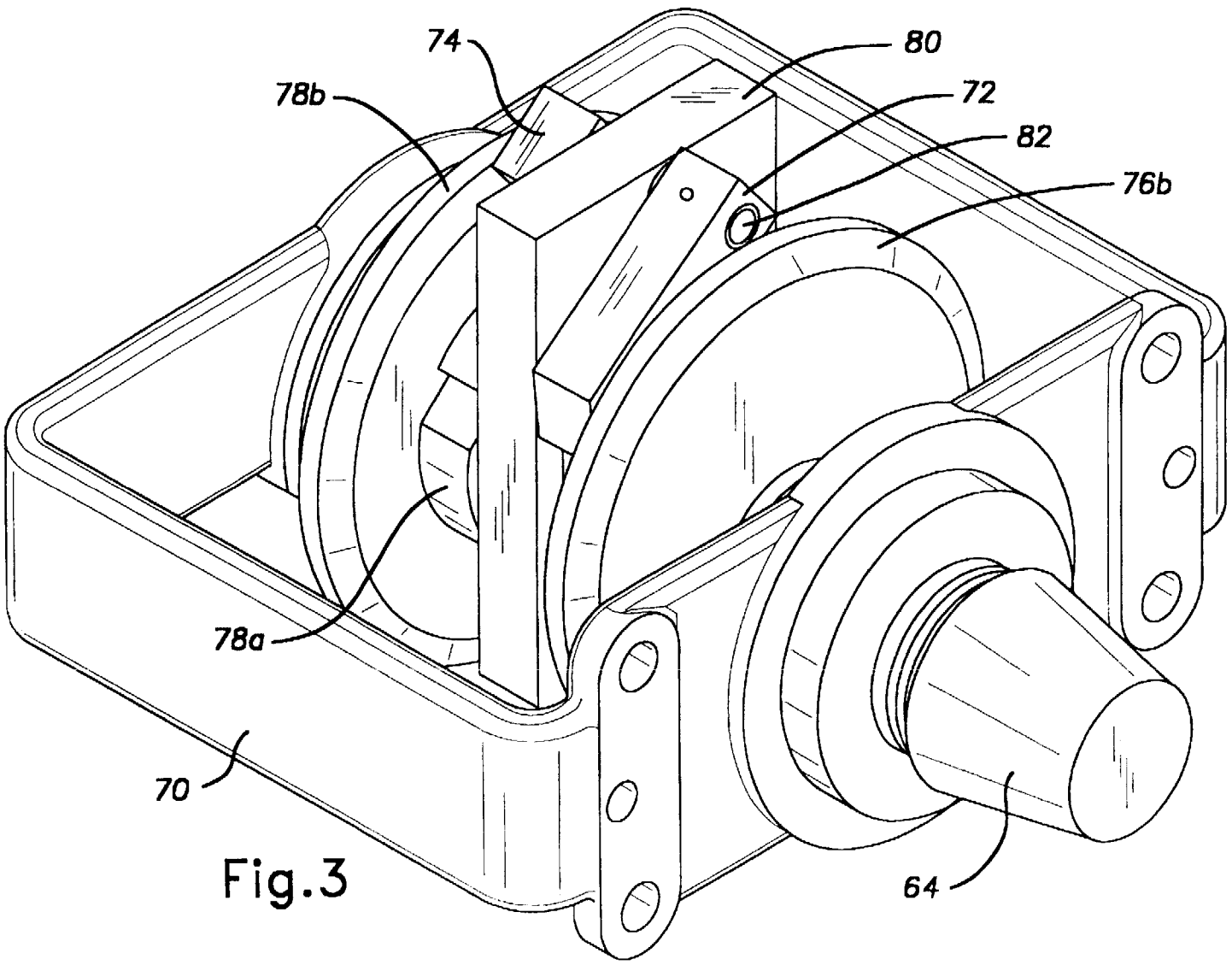
FIG. 3 is a perspective view of an indexing mechanism according to the present invention.
Figure 5:
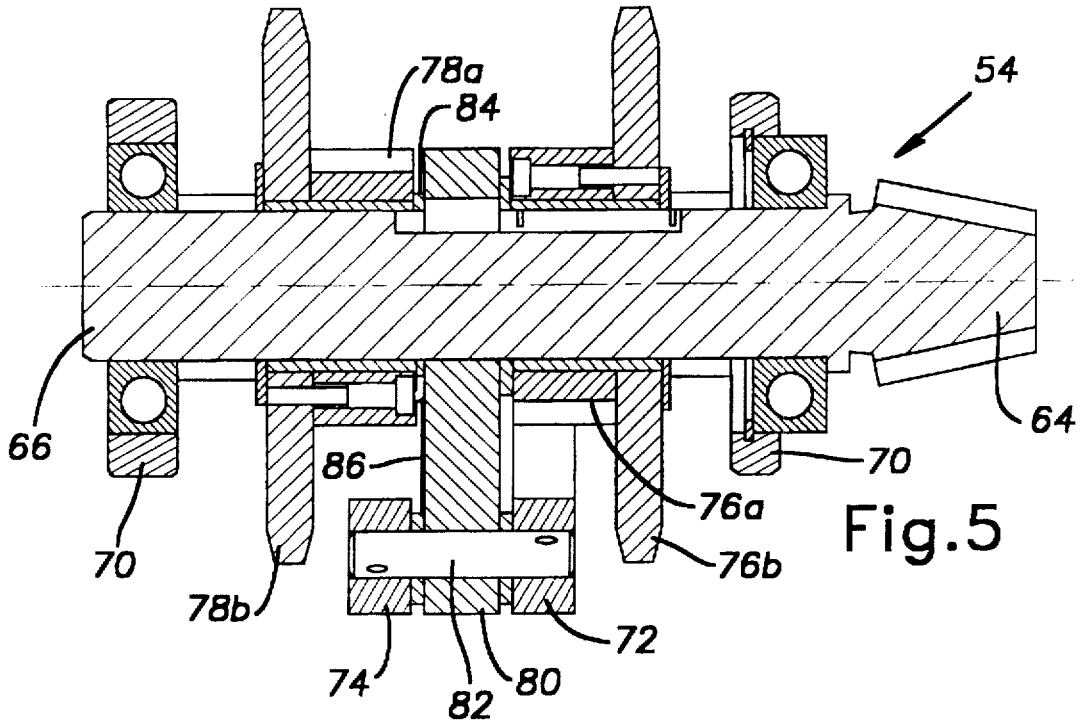
FIG. 5 is a cross sectional view of the indexing mechanism as seen along line A—A in FIG. 4.
Figure 4:
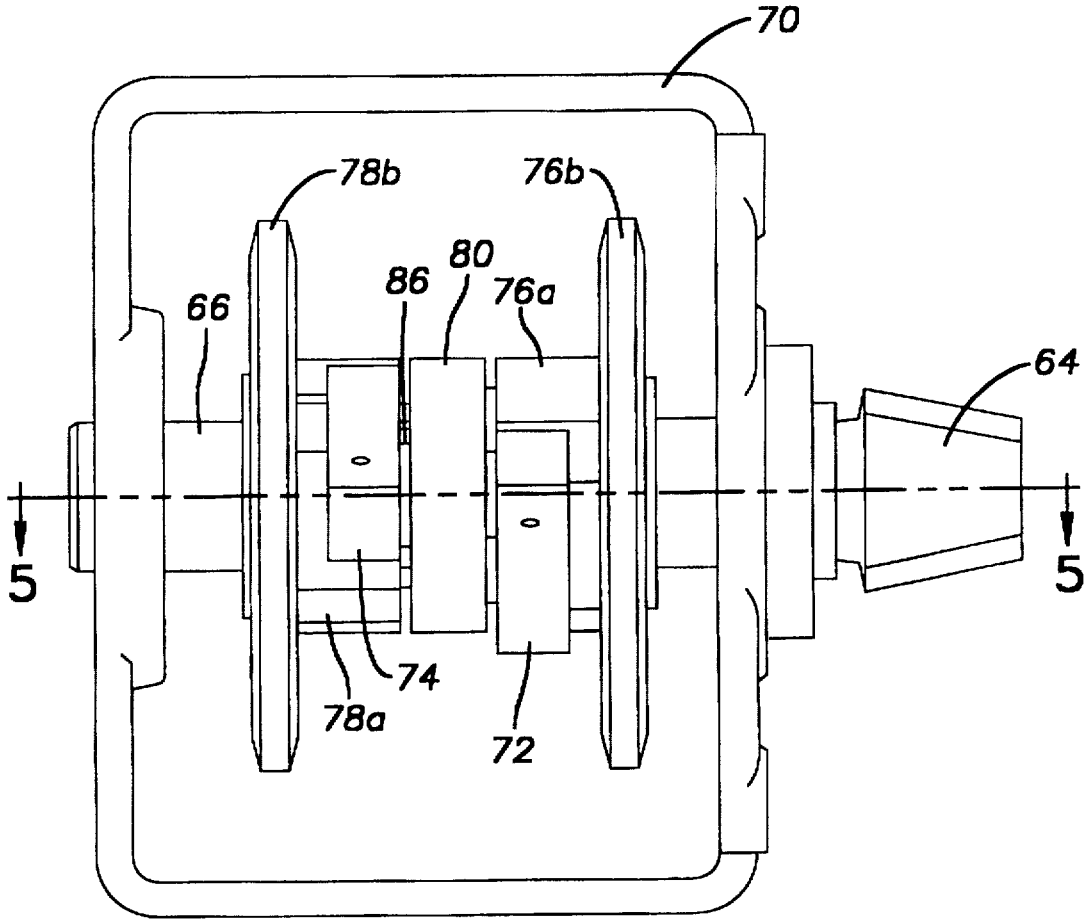
FIG. 4 is a top plan view of the indexing mechanism shown in FIG. 3.
Figure 6A:
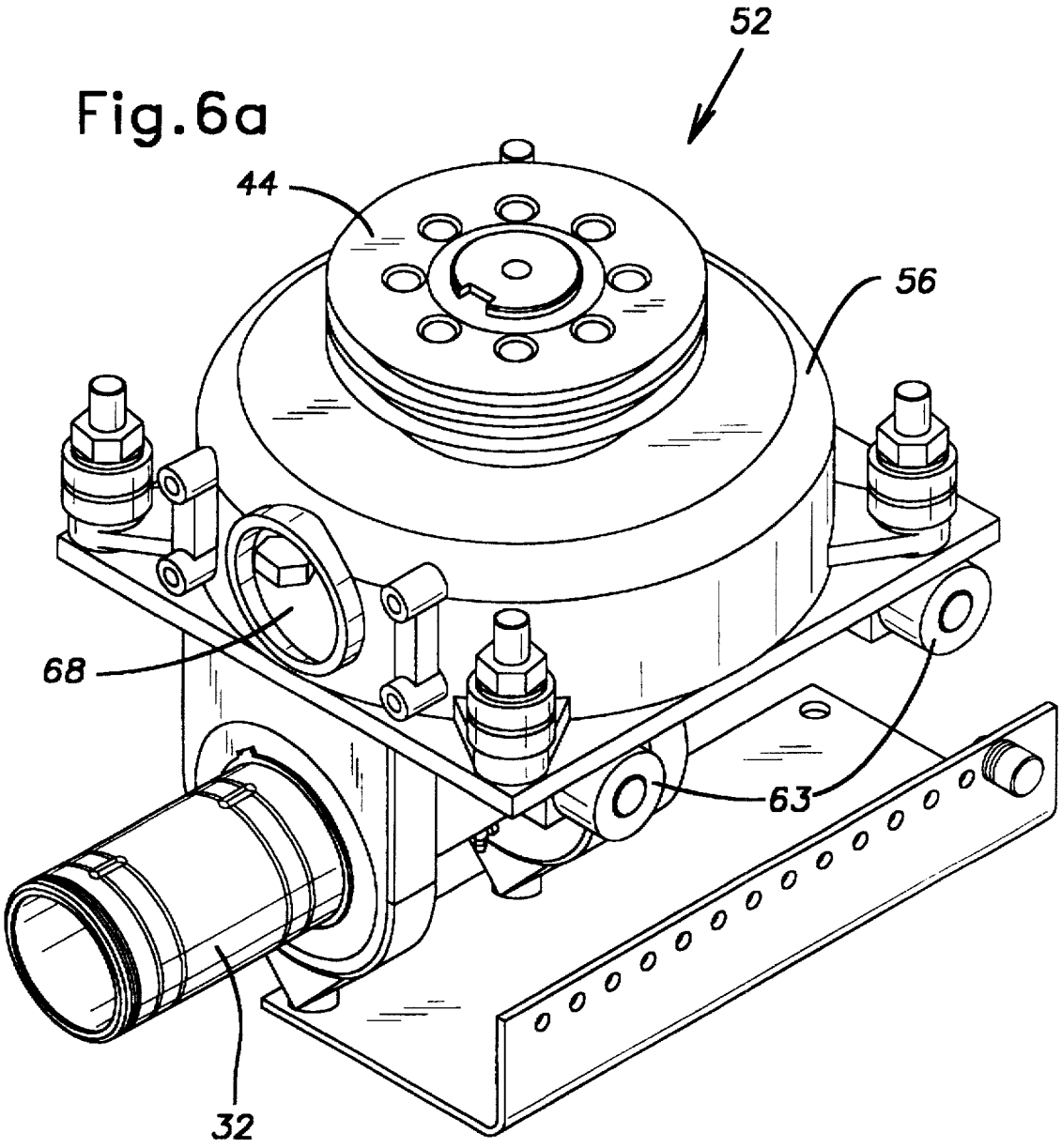
FIG. 6*a* is a perspective view of a spindle housing assembly.
Figure 6B:
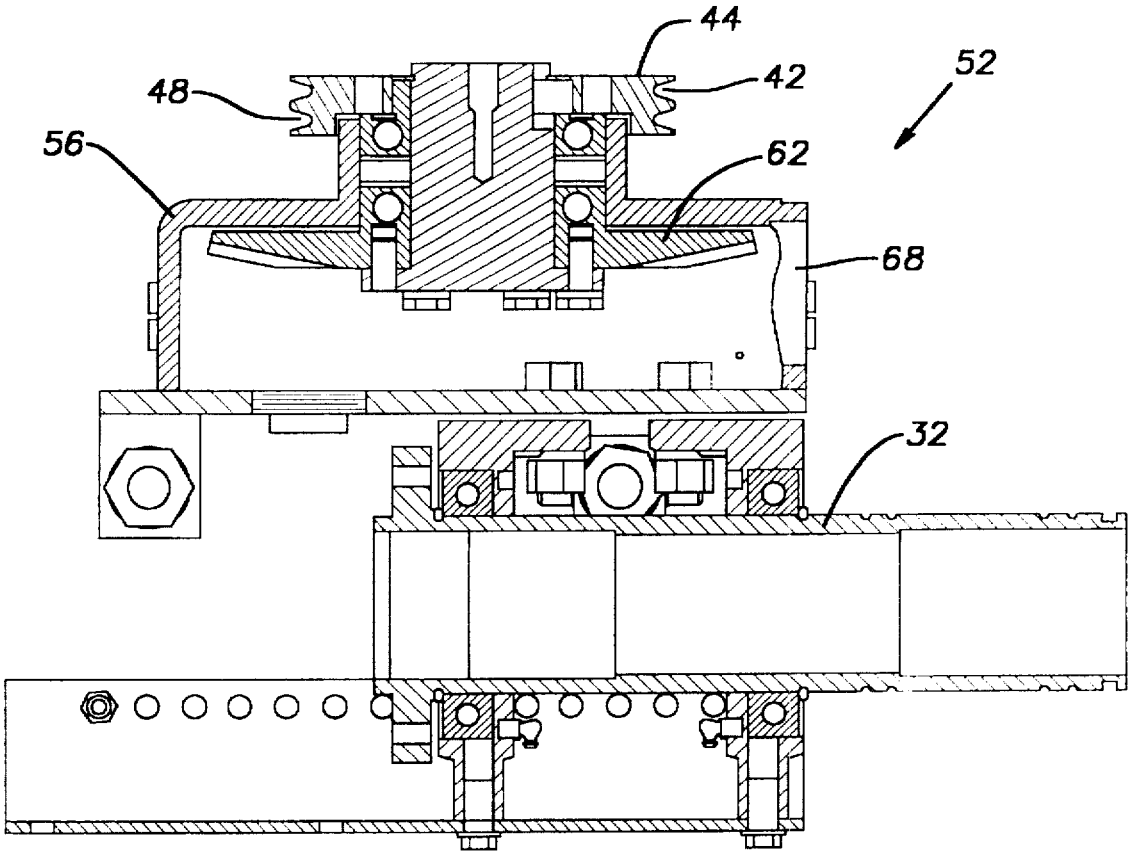
FIG. 6*b* is a cross sectional view of the spindle housing assembly shown in FIG. 6*a;*

As shown best in FIGS. 3–5, the pinion 64 is a component of a pinion assembly that includes first and second pawls 72, 74, first and second ratchet/sprocket assemblies 76, 78, a pawl plate 80, a pawl shaft 82, an indexing star 84, and a torsion spring 86. The pawl plate 80 is keyed to the pinion shaft 66, and the pawl shaft 82 extends through the pawl plate 80. The first and second pawls 72, 74 are pinned to opposite ends of the pawl shaft 82. The pawl shaft freely rotates within the pawl plate.

The ratchet/sprocket assemblies 76, 78 are mounted over the pinion shaft 66 and are free to rotate relative to the pinion 64. Each ratchet/sprocket assembly 76, 78 includes a ratchet **76*a*, 78*a* and a sprocket 76*b*, 78*b* that are secured to one another by a series of screw-type fasteners. The ratchets 76*a*, 78*a* are in alignment with their associated pawls 72, 74 and serve as sprocket hubs. Each ratchet 76*a*, 78*a* is selectively engaged by its associated pawl 72, 74 depending upon the direction of pinion 64 rotation. The ratchet/sprocket assemblies 76, 78 are oriented in opposite directions such that one pawl and ratchet will be engaged during clockwise rotation of the pinion and the other ratchet and pawl will be engaged during counterclockwise rotation of the pinion. Each pinion sprocket 76*b*, 78*b* is rotatably connected, by means of a drive chain 88, to an associated one of the spindle sprockets 58, 60**, as should be apparent from the drawings and description to follow.

Figure 7:
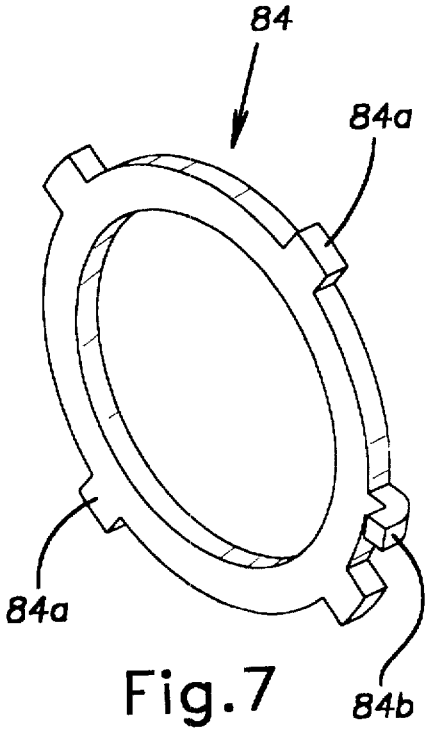
FIG. 7 is an indexing star according to the present invention.
Figure 8A:
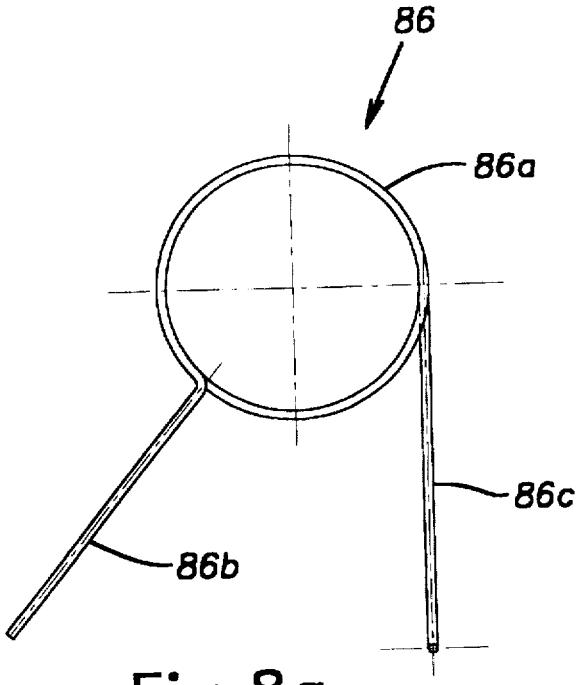
FIGS. 8*a*–8*c* illustrate a torsion spring according to the present invention.
Figure 8B:
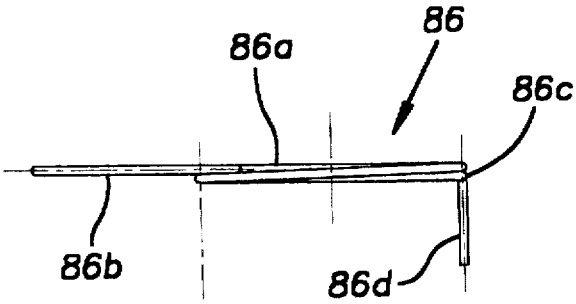
Figure 8C:
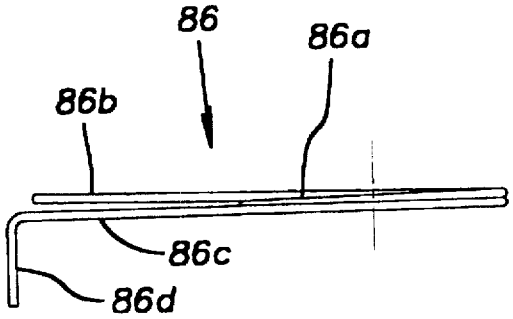

The indexing star 84 is disposed around the pinion shaft 66 and between the pawl plate 80 and one of the ratchet/sprocket assemblies 78. As shown best in FIG. 7, the indexing star 84 has a series of radial tabs **84*a* and a bent tab 84*b*. The bent tab 84*b* is inserted into an accommodating opening in one of the screw-type fasteners in the ratchet 78*a* to prevent the indexing star 84 from rotating relative to the ratchet 78*a*. The indexing star 84 is, however, able to rotate relative to the pinion shaft 64 and the pawl plate 80**.

The torsion spring 86 provides an engagement/disengagement mechanism for the pawls. As shown best in FIGS. **8*a*–8*c*, the torsion spring 86 has a coiled portion 86*a* and a pair of legs 86*b*, 86*c*. A first leg 86*b* extends radially away from the coiled portion 86*a*. A second, opposite leg 86*c* extends tangentially away from the coiled portion 86*a*. The terminal end 86*d* of the second leg 86*c* is bent at ninety degrees, and is inserted into a hole in the second pawl 74. The coiled portion 86*a* is wrapped around the pawl shaft 82. The first leg 86*b* extends toward and engages the tabbed peripheral edge of the indexing star 84**.

As such, the torsion spring 86 cooperates with the indexing star 84 to rotate the pawl shaft 82 and, hence, the pawls 72, 74. Rotation of the pinion shaft 66 in one direction causes the torsion spring 86 to rotate the first pawl 72 into engagement with the first ratchet **76*a*. Rotation of the pinion shaft 66 in an opposite direction causes the torsion spring 86 to rotate the second pawl 74 into engagement with the second ratchet 78*a***.

During start up, or during a change in direction of lance travel, both pawls 72, 74 will be, at least temporarily, positioned so that neither one engages its associated ratchet **76*a*, 78*a*. Assuming this is the initial pawl position at the beginning of the soot blower cycle, the sheave wheel pulley 44 will begin to translate and rotate. Because neither pawl 72, 74 is engaged with the ratchet 76*a*, 78*a*, the lance tube 30** will initially translate without rotating.

However, the bevel gear 62, pinion 64, pawl plate 80, pawls 72, 74, and torsion spring 86 will be rotated. The first torsion spring leg **86*b* will be tripped by one of the tabs 84*a* on the indexing star 84**, forcing the associated pawl into its ratchet to initiate rotation of the ratchet and, hence, the pinion sprocket. The other pawl is forced away from its associated ratchet by operation of the spring.

When the soot blower reverses direction, the previously disengaged pawl and ratchet will engage and the previously engaged pawl and ratchet will disengage. Therefore, there is lost motion (i.e., a period of translation without rotation) whenever the soot blower is energized and reversed.

The first pinion sprocket **76*b* is linked by a drive chain 88 to a first spindle sprocket 58. The first spindle sprocket 58 is keyed or otherwise secured over the spindle 32 such that the spindle 32 and first spindle sprocket 58 rotate together. When the first pinion sprocket 76*b* rotates due to action of the torsion spring 86 to engage the first pawl 72 with the first ratchet 76*a*, the first spindle sprocket 58 is rotated by the drive chain 88 and, thus, the spindle 32 and the lance tube 30 are rotated. Rotation of the spindle 32 causes the second spindle sprocket 60 to rotate, and thereby back drives the second pinion sprocket 78*b* via the drive chain 88. However, since the second pawl 74 is disengaged from the second ratchet 78*a* due to action of the torsion spring 86**, back driving of the second pinion sprocket is not a problem.

Similarly, the second pinion sprocket **78*b* is linked by the drive chain 88 to the second spindle sprocket 60. The second spindle sprocket 60 is keyed or otherwise secured over the spindle 32 such that the spindle 32 and second spindle sprocket 60 rotate together. When the second pinion sprocket 78*b* rotates due to action of the torsion spring 86 to engage the second pawl 74 with the second ratchet 78*a*, the second spindle sprocket 60 is rotated by the drive chain 88 and, thus, the spindle 32 and the lance tube 32 are rotated. Rotation of the spindle 32 causes the first spindle sprocket 58 to rotate, and thereby back drives the first pinion sprocket 76*b* via the drive chain 88. However, since the first pawl 72 is disengaged from the first ratchet 76*a* due to action of the torsion spring 86, back driving of the first pinion sprocket 76*b*** is not a problem.

Therefore, it should be apparent that with the assembly described above the lance tube 30 is rotated and translated, and that there is lost motion each time the traveling carriage changes or reverses direction. The lost motion indexes the lance tube so that the spray pattern from the cleaning medium emanating from the lance tube spray nozzle(s) will traverse a different path upon subsequent extend/retract cycles. The amount of lost motion is variable due to different sprocket ratios. Therefore, infinite random indexing of the lance tube occurs. It should also be noted that the lance tube reverses direction of rotation. More specifically, the lance tube rotates one direction on the extend cycle (i.e., clockwise) and rotates the opposite direction (i.e., counterclockwise) on the retract cycle.

It is believed that it may be advantageous to have the lance tube rotate in a single direction on both the extend and the retract cycles. A simple modification to the present invention, presented schematically in FIGS. **9*a*–9*d* illustrate a second embodiment of the present invention wherein the lance tube rotates in a single direction during both the extend and retract cycles. Generally, the main difference between the first embodiment, described hereinbefore with regard to FIGS. 1–8, and the second embodiment, shown in FIGS. 9a–9d, is the inclusion of a pair of idler rollers 90, 92 between the second pinion sprocket 78b and the second spindle sprocket 60**.

Figure 9A:
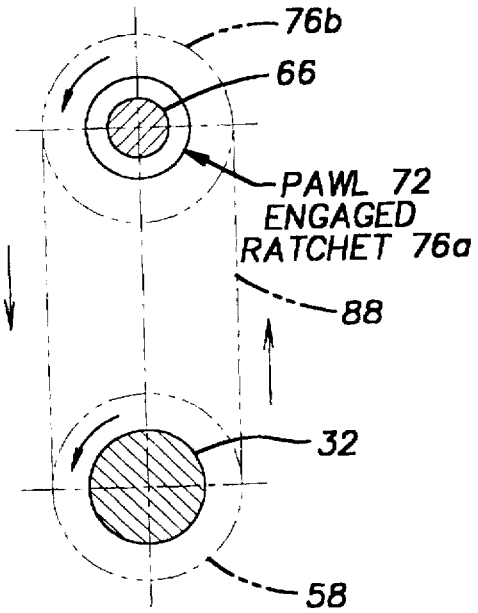
FIGS. 9*a*–9*d* schematically illustrate operation of the indexing mechanism according to a second embodiment of the present invention.

During an extending movement of the lance, and with reference to FIG. 9a, the operation of the first pinion sprocket 76b to rotatably drive the first spindle sprocket 58 via the drive chain 88 is illustrated. The spindle 32 is rotated counterclockwise by the first spindle sprocket 58. It is noted that the operation of the first pinion sprocket and the first spindle sprocket is generally identical to that described hereinbefore with regard to the first embodiment of the present invention. In this mode of operation, the first pawl 72 is engaged with the first ratchet 76a and the second pawl 74 is disengaged from the second ratchet 78a (FIG. 9b). FIG. 9b shows the operation of the second pinion sprocket 78b and second spindle sprocket 60. The spindle 32 rotates counterclockwise, and, since the drive chain 88 is wrapped around the idler sprockets 90, 92, the second pinion sprocket 78b is rotated clockwise (opposite to that of the first pinion sprocket 76b).

Figure 9C:
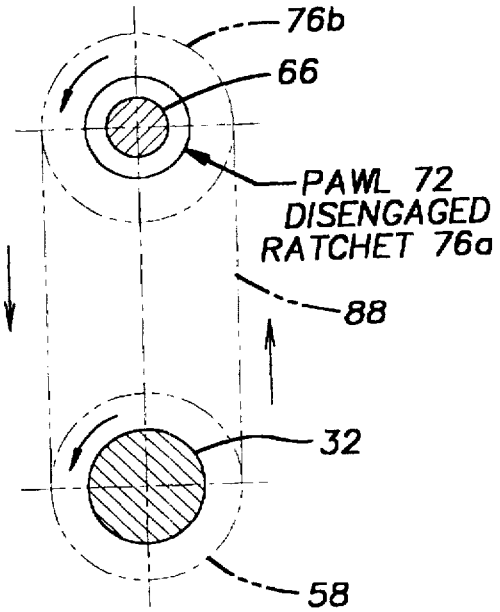
Figure 9B:
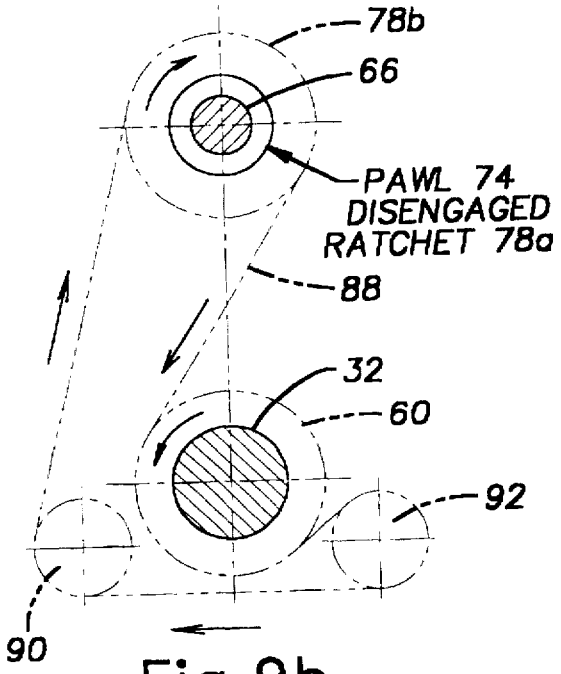
Figure 9D:
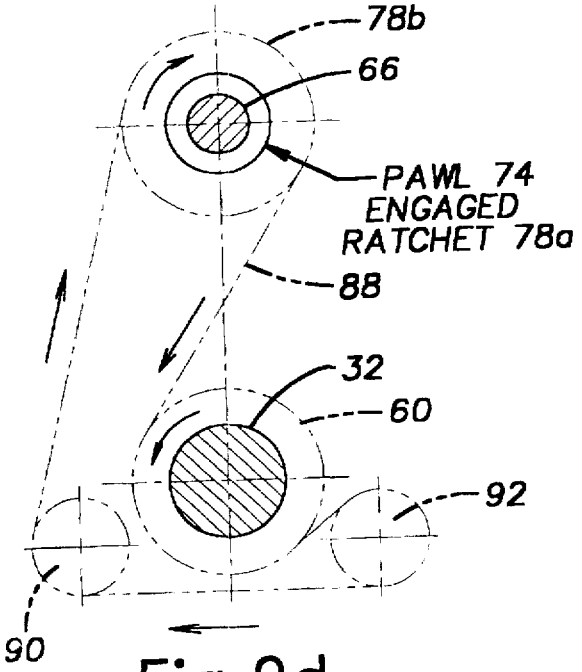

During a retracting movement of the lance, and with reference to FIG. 9c, the first pawl 72 is disengaged from the first pinion ratchet 76a. Therefore, the first spindle sprocket 58 is not driven by the first pinion sprocket 76b. Rather, the second pawl 74 engages the second pinion ratchet 78a and drives the second pinion sprocket 78b. The drive chain 88, which passes around the idler sprockets 90, 92, continues to drive the second spindle sprocket 60 and the spindle 32 in a counterclockwise direction, as illustrated in FIG. 9d. As such, the spindle, via the drive chain 88, back-drives the first pinion sprocket 76b. Therefore, the spindle and lance tube are rotated in the identical direction regardless of whether the lance is being extended or retracted.

Preferably, the front sprocket sizes are different than the rear sprocket sizes so that the spindle rotates at a first extension speed and a second retraction rate. Therefore, the helical path traversed during extension will be different than the helical path traversed during retraction. Moreover, providing different sprocket ratios permits the amount of lost motion during a change in direction to be variable. As such, lost motion is a variable which affects the indexing of the lance tube and, therefore, the lance indexing is random and variable to provide a random and variable cleaning pattern.

While the preferred embodiment of the present invention is shown and described herein, it is to be understood that the same is not so limited but shall cover and include any and all modifications thereof which fall within the purview of the invention.

What is claimed is:

1. A soot blower assembly comprising a lance, a spindle secured to the lance for common rotation therewith, and a traveling carriage, said traveling carriage being operable to impart translational and rotational motion on said lance, said traveling carriage including an indexing mechanism, said indexing mechanism including:

first and second spindle sprockets;

a pinion, said pinion being rotatably driven by a drive means and including a first pinion sprocket and a second pinion sprocket;

a first member rotatably linking the first spindle sprocket to the first pinion sprocket;

a second member rotatably linking the second spindle sprocket to the second pinion sprocket; and, a clutch, said clutch being operable to link said pinion to one of said first and second pinion sprockets for common rotation dependent upon a direction of pinion rotation, whereby rotation of said pinion in a first direction is communicated to said lance via said first pinion sprocket and said first spindle sprocket and rotation of said pinion in a second, opposite direction is communicated to said lance via said second pinion sprocket and said second spindle sprocket.

2. A soot blower assembly according to claim 1, wherein said lance tube rotates in one direction during an extension stroke and in an opposite, second direction during a retraction stroke.

3. A soot blower assembly according to claim 1, wherein said lance tube rotates in one direction during both an extension stroke and a retraction stroke.

* * * * *

UNITED STATES PATENT AND TRADEMARK OFFICE

CERTIFICATE OF CORRECTION

PATENT NO. : 5,752,288

DATED : May 19, 1998

INVENTOR(S) : Parkin et al.

It is certified that error appears in the above-identified patent and that said Letters Patent is hereby corrected as shown below:

On the title page, Item [56], "References Cited, U.S. PATENTS DOCUMENTS", delete "3,230,658" and insert --3,230,568--.

"References Cited, U.S. PATENT DOCUMENTS", insert --2,324,785 7/1943 Linaker--.

"References Cited, U.S. PATENT DOCUMENTS", insert --2,885,711 5/1959 DeMart--.

"References Cited, U.S. PATENT DOCUMENTS", insert --2,932,053 4/1960 McColl--.

"References Cited, U.S. PATENT DOCUMENTS", insert --4,177,539 12/1979 Elting--.

"References Cited, U.S. PATENT DOCUMENTS", insert --4,229,854 10/1980 Johnston, Jr.--.

UNITED STATES PATENT AND TRADEMARK OFFICE

CERTIFICATE OF CORRECTION

PATENT NO. : 5,752,288

DATED : May 19, 1998

INVENTOR(S) : Parkin et al.

It is certified that error appears in the above-identified patent and that said Letters Patent is hereby corrected as shown below:

"References Cited, U.S. PATENT DOCUMENTS", insert --4,248,180 2/1981 Sullivan et al.--.

"References Cited, U.S. PATENT DOCUMENTS", insert --4,257,359 3/1981 Capobianco--.

"References Cited, U.S. PATENT DOCUMENTS", insert --4,351,082 9/1982 Ackerman et al.--.

"References Cited, U.S. PATENT DOCUMENTS", insert --4,399,773 8/1983 Schwade et al.--.

"References cited, U.S. PATENT DOCUMENTS", insert --4,437,201 3/1984 Zalewski--.

"References cited, U.S. PATENT DOCUMENTS", insert --4,492,187 1/1985 Hammond--.

"References cited, U.S. PATENT DOCUMENTS", insert --4,498.213 2/1985 Zalewski--.

UNITED STATES PATENT AND TRADEMARK OFFICE

CERTIFICATE OF CORRECTION

PATENT NO. : 5,752,288 PAGE 3 OF 3

DATED : May 19, 1998

INVENTOR(S) : Parkin et al.

It is certified that error appears in the above-identified patent and that said Letters Patent is hereby corrected as shown below:

"References cited, U.S. PATENT DOCUMENTS", insert --5,065,472 11/1991 Carpenter et al.--.

"References cited, U.S. PATENT DOCUMENTS", insert --5,090,087 2/1992 Hipple et al.--.

"References cited, U.S. PATENT DOCUMENTS", insert --5,267,533 12/1993 Smith--.

"References cited, U.S. PATENT DOCUMENTS", insert --5,277,153 1/1994 Kakabaker--.

"References cited, U.S. PATENT DOCUMENTS", insert --5,337,441 8/1994 Miyamoto et al.--.

"References cited, FOREIGN PATENT DOCUMENTS", insert --1,082,363 5/1960 Germany--.

Signed and Sealed this

Eighteenth Day of May, 1999

*Attest:*

Q. TODD DICKINSON

*Attesting Officer*

*Acting Commissioner of Patents and Trademarks*